US009228328B2

(12) United States Patent
Chen et al.

(10) Patent No.: US 9,228,328 B2
(45) Date of Patent: Jan. 5, 2016

(54) INSTALLATION STRUCTURE OF COUNTERTOP FAUCET

(71) Applicants: Ming-Hung Chen, Yunlin County (TW); Chih-Chiang Chang, Taichung (TW)

(72) Inventors: Ming-Hung Chen, Yunlin County (TW); Chih-Chiang Chang, Taichung (TW)

( * ) Notice: Subject to any disclaimer, the term of this patent is extended or adjusted under 35 U.S.C. 154(b) by 496 days.

(21) Appl. No.: 13/831,855

(22) Filed: Mar. 15, 2013

(65) Prior Publication Data

US 2013/0291959 A1 Nov. 7, 2013

(30) Foreign Application Priority Data

May 7, 2012 (TW) ..... 101208546 U

(51) Int. Cl.
*E03C 1/042* (2006.01)
*E03C 1/04* (2006.01)

(52) U.S. Cl.
CPC ..... *E03C 1/0401* (2013.01); *E03C 1/0403* (2013.01); *E03C 2001/0416* (2013.01); *Y10T 137/598* (2015.04)

(58) Field of Classification Search
CPC ..... E03C 1/04; E03C 1/0401; E03C 1/0402; E03C 1/0412; E03C 1/0417; E03C 1/042; E03C 1/104; E03C 2001/416; E03C 2001/417; F16B 7/14; F16B 7/105
USPC ..... 137/15.01, 15.18, 315.07, 315.12, 137/315.13, 359, 454.6, 801; 4/671–678, 4/695; 403/DIG. 6, 109.3, 377, 378, 403/379.1
See application file for complete search history.

(56) References Cited

U.S. PATENT DOCUMENTS

| | | | | | |
|---|---|---|---|---|---|
| 3,469,603 | A * | 9/1969 | Nagel | E03C 1/0404 | 137/599.08 |
| 4,262,699 | A * | 4/1981 | Fabian | E03C 1/0401 | 137/615 |
| 6,006,784 | A * | 12/1999 | Tsutsui | E03C 1/0403 | 137/359 |
| 6,138,716 | A * | 10/2000 | Yen | E03C 1/0404 | 137/801 |
| 6,301,728 | B1 * | 10/2001 | Pilatowicz | E03C 1/0401 | 137/360 |
| 7,434,495 | B2 * | 10/2008 | Lin | B25B 13/461 | 16/429 |
| 7,735,519 | B2 * | 6/2010 | Lin | E03C 1/0401 | 137/315.12 |
| 2006/0185076 | A1 * | 8/2006 | Huber | E03C 1/0401 | 4/677 |

* cited by examiner

*Primary Examiner* — Kevin P Shaver
*Assistant Examiner* — Nicholas Ros
(74) *Attorney, Agent, or Firm* — Leong C. Lei

(57) ABSTRACT

An installation structure of countertop faucet includes a base having an insertion section extending through a mounting hole formed in a counter to engage a locking nut to be secured. The insertion section has a top end forming a receiving bore of which a circumferential wall forming two positioning holes communicating with the receiving bore. Each positioning hole receives therein a releasing module. The bottom of the base forms two water inlet passages communicating with the receiving bore and receiving stop valves therein and coupled to couplers for connection with water inlet tubes. A faucet has a joint section received in the receiving bore and having water guide tubes fit into the water inlet passages. The joint section forms two receiving apertures receiving therein positioning modules respectively engageable with the positioning holes to fix the faucet and being released by the releasing module to detach the faucet from the base.

9 Claims, 10 Drawing Sheets

INSTALLATION STRUCTURE OF COUNTERTOP FAUCET

TECHNICAL FIELD OF THE INVENTION

The present invention generally relates to the field of mounting/dismounting faucet, and more particularly to an installation structure enabling easy, efficient, and simple mounting and/or dismounting of a faucet on a countertop, including a lavatory countertop or a basin countertop.

DESCRIPTION OF THE PRIOR ART

In installing or replacing a faucet mounted on a basic countertop or a lavatory countertop, water pipes connected to the faucet must be closed first before dismounting/mounting operation can be carried out. After the installation, the water pipes must be opened again to inspect if any leak occurs.

To install the countertop faucet, a lower end portion of the faucet must be first inserted into an installation hole that is previously formed in the countertop. A nut is then set into engagement with the lower end portion of the faucet from the underside of the countertop to secure the faucet on the countertop. After that, the water pipe is connected to the faucet. For non-professional people, due to insufficiency of experience, such an installation structure often causes problems, such as the faucet being installed to face an incorrect direction and water leaking. Repeated mounting and dismounting may be needed before the installation is correctly done. Such a known faucet installation structure always leads to an inconvenient, time-consuming, and troublesome operation of installation. Particularly, in general houses, the switch valve of the water pipe is often distant from the installation site of the faucet and people who carry out faucet installation must walk back and forth between the water pipe switch valve and the installation site for many times, making a great waste of time. Further, in certain situations, people may not find out where the water pipe switch valve is located, particularly for old apartments or buildings, which often have no water pipe switch valve installed indoors. People must search outdoors for the water valve switch. Sometimes, the water pipe can only be shut down with a general valve that is quite distant from the site where the faucet is to be installed. This causes extreme inconvenience for instillation of faucet and other applications.

In view of such problems, the present invention aims to provide a solution to overcome such problems.

SUMMARY OF THE INVENTION

The primary object of the present invention is to provide an installation structure of countertop faucet that enables easy, efficient, and simple mounting/dismounting of a faucet on a countertop, such as lavatory countertop and a basin countertop.

Specifically, the present invention provides an installation structure of countertop faucet, which comprises a base, a locking nut, a faucet, two positioning modules, two releasing modules, a cover, two stop valves, and two couplers. The base comprises a seat that abuts an underside of a top of a counter and an insertion section having a reduced diameter and extending through a mounting hole of the counter to partially project beyond the counter. The insertion section has a top end in which a receiving bore is formed and delimited by a circumferential wall that has an outside surface forming an external thread section and two positioning holes that are formed in and extending through the circumferential wall at a location above the external thread section to be in communication with the receiving bore. The seat has a bottom surface in which two water inlet passages are formed to communicate with the receiving bore. The locking nut is fit to and engages the external thread section of the insertion section in order to cooperate with the seat to clamp the counter. The faucet comprises a joint section that is receivable in the receiving bore. The joint section has a bottom end surface to which two water guide tubes are provided for respectively inserting into the two water inlet passages. The joint section is provided, at opposite sides thereof, with receiving apertures. The two positioning modules are respectively received in the two receiving apertures. Each of the positioning modules comprises a positioning bead and a positioning spring. The positioning spring biases the positioning bead outward to get into a corresponding one of the positioning holes. The two releasing modules are respectively arranged in the two positioning holes. Each of the releasing modules comprises a push button adapted to be pushed inwardly from outside to drive the positioning bead out of the positioning hole. The cover is fit over the joint section in an axially movable manner to cover the locking nut and a portion of the insertion section that projects beyond the counter. The two stop valves are respectively set in and thus selectively block the two water inlet passages, whereby when the joint section is received in the receiving bore, the two water guide tubes drive the two stop valves to open the communication between the two water inlet passages and the two water guide tube. The two couplers are respectively coupled to lower end openings of the two water inlet passages and adapted to connect water inlet tubes so as to guide an external supply of water into the water inlet passages.

As such, the locking nut secures the base to the counter to allow the joint section of the faucet to efficiently fit into the receiving bore of the base and the positioning beads of the two positioning modules may get into retaining engagement with the two positioning holes to achieve efficient installation of the faucet. Further, the push buttons of two releasing modules may be operated to push away the positioning beads that are in engagement with the positioning holes so as to achieve efficient dismounting and removal of the faucet. Thus, with the base being mounted in advance to the counter by a plumber, an ordinary person may then mount or dismount the faucet in an easy and efficient manner without any concern of water leaking. Particularly, the arrangement that the two stop valves allow the two water inlet passages to communicate with the two water guide tubes only when the faucet is mounted to the base and immediately block the two water inlet passages once the faucet is dismounted and removed from the base makes it possible not to shut down the switch valve of water supply in installing the faucet. This saves a great amount of installation time and also saves a lot of troubles of installation.

According to the present invention, the receiving bore has inner surface in which two slide grooves are respectively formed at opposite portions thereof. The two slide grooves respectively extend from the two positioning holes to the top end surface of the insertion section, whereby when each of the positioning beads is moved inwardly into the corresponding receiving aperture to an innermost limit, the positioning bead projects beyond the surface of the joint section by a predetermined distance that is sufficient to allow the positioning bead to be received and retained in the corresponding slide groove. As such, the two slide grooves may guide the two positioning beads so that the faucet is only allowed to be jointed to the base at a predetermined direction and the faucet being mounted in an incorrect direction can be prevented.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
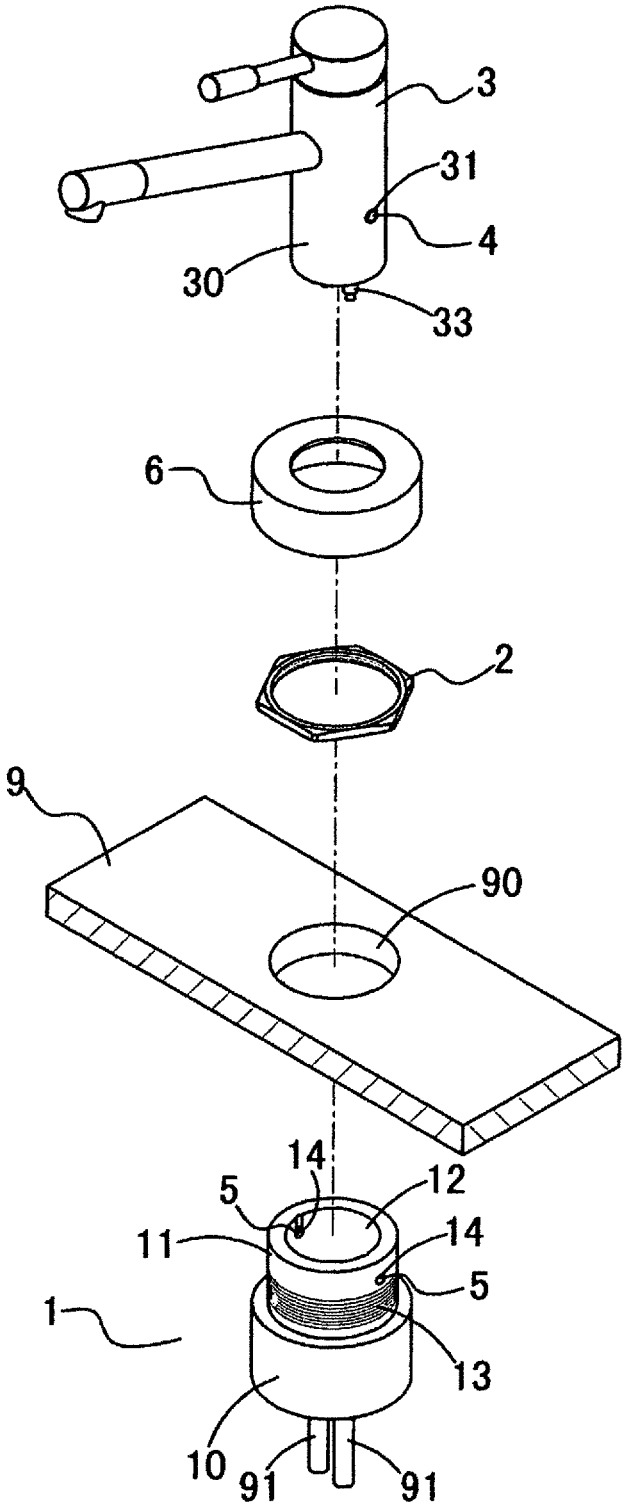
FIG. 1 is an exploded view showing the present invention.
Figure 2:
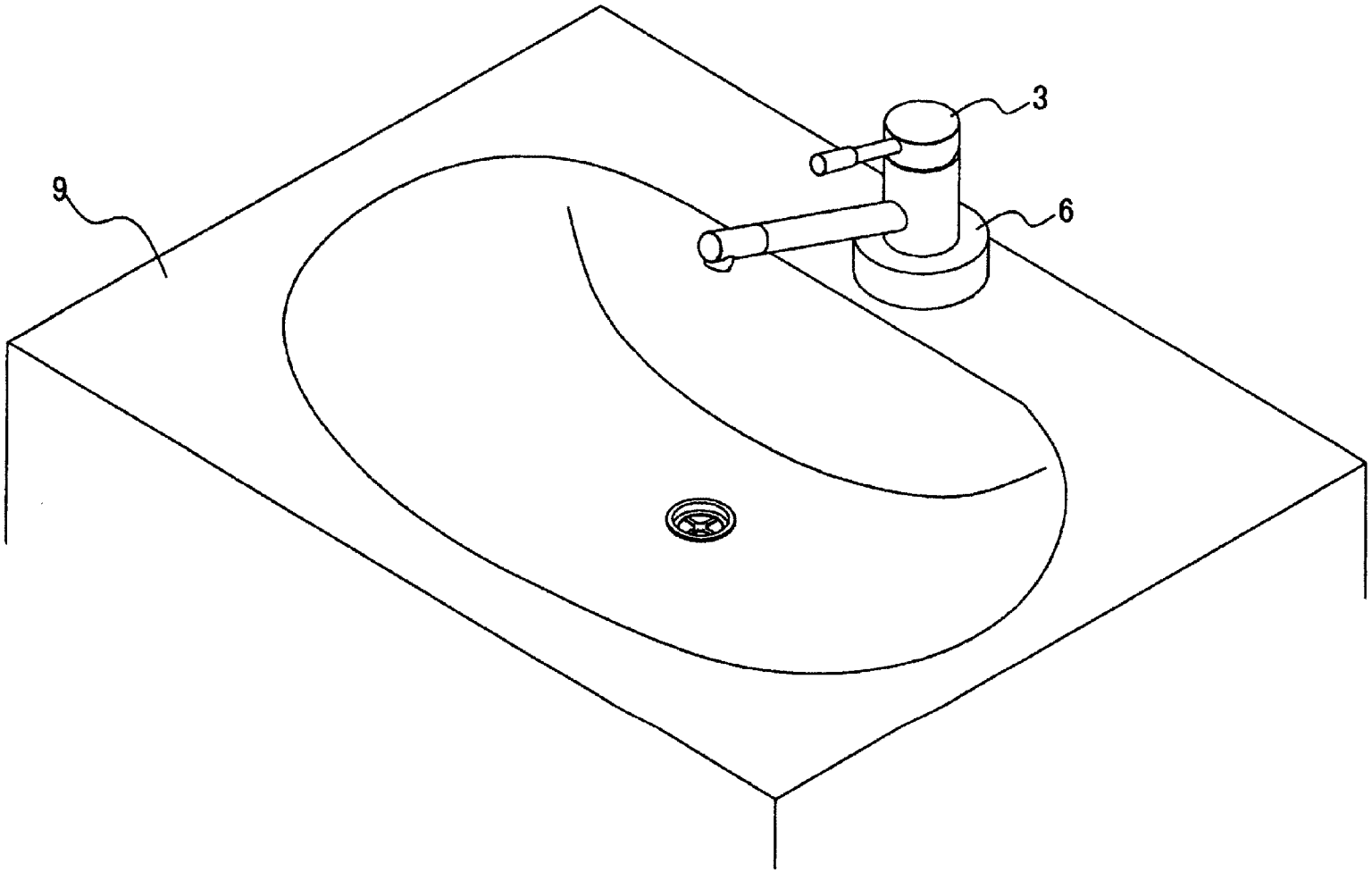
FIG. 2 is a perspective view showing the present invention in an assembled form mounted on a wash basin.
Figure 3:
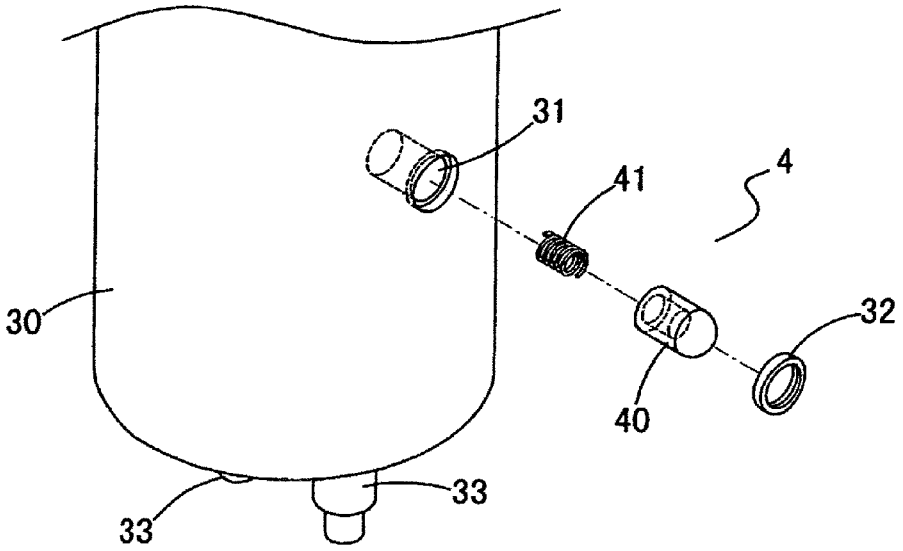
FIG. 3 is an exploded view showing a positioning module of the present invention.
Figure 4:
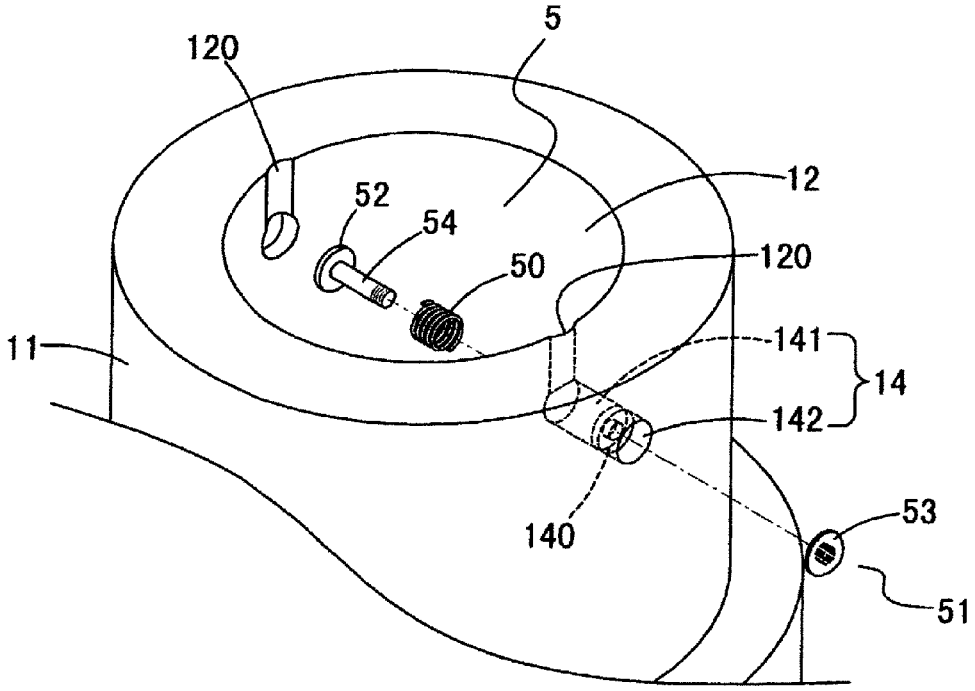
FIG. 4 is an exploded view showing a releasing module of the present invention.
Figure 5:
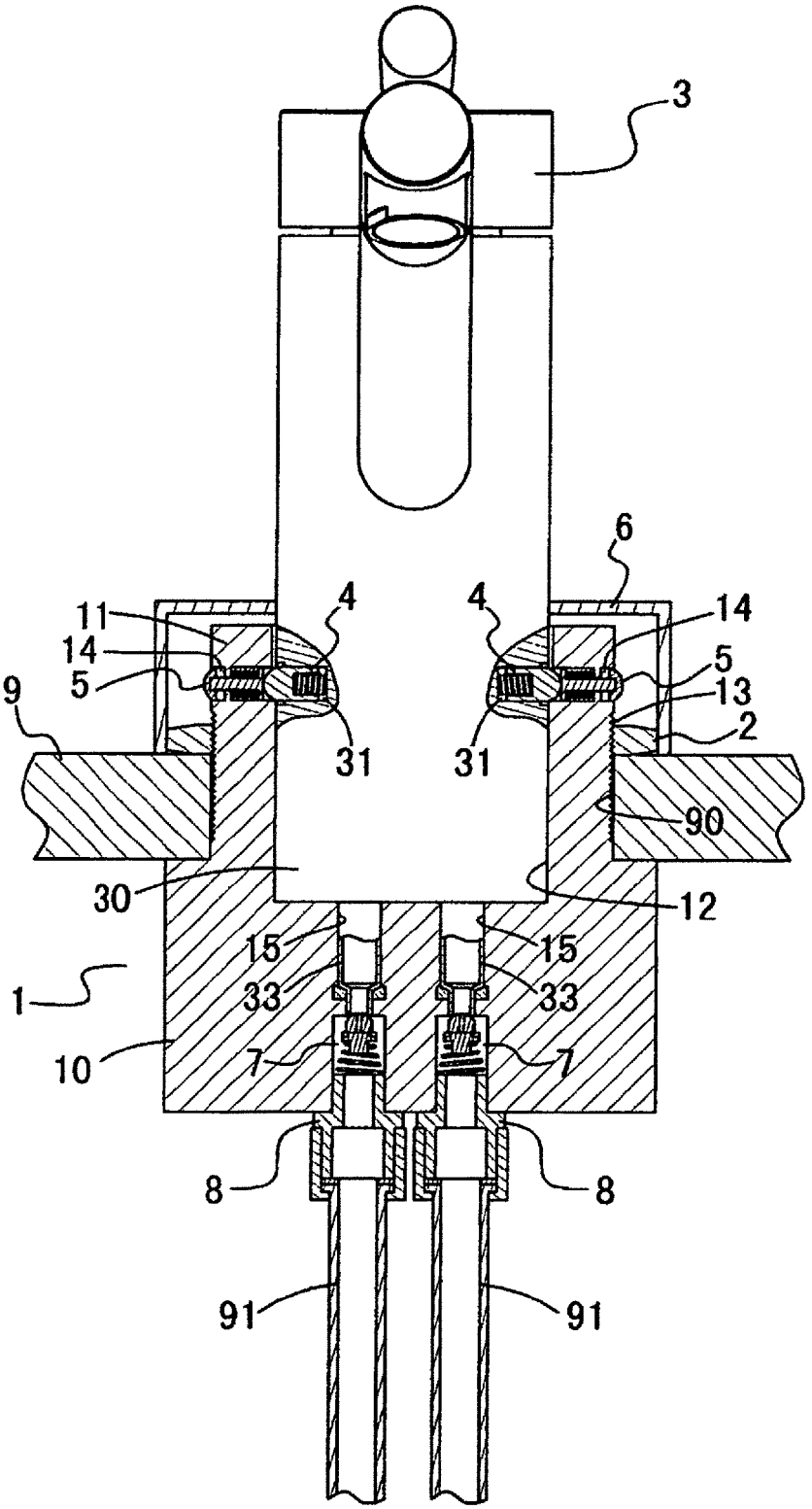
FIG. 5 is a cross-sectional view showing the present invention in an assembled form.
Figure 6:
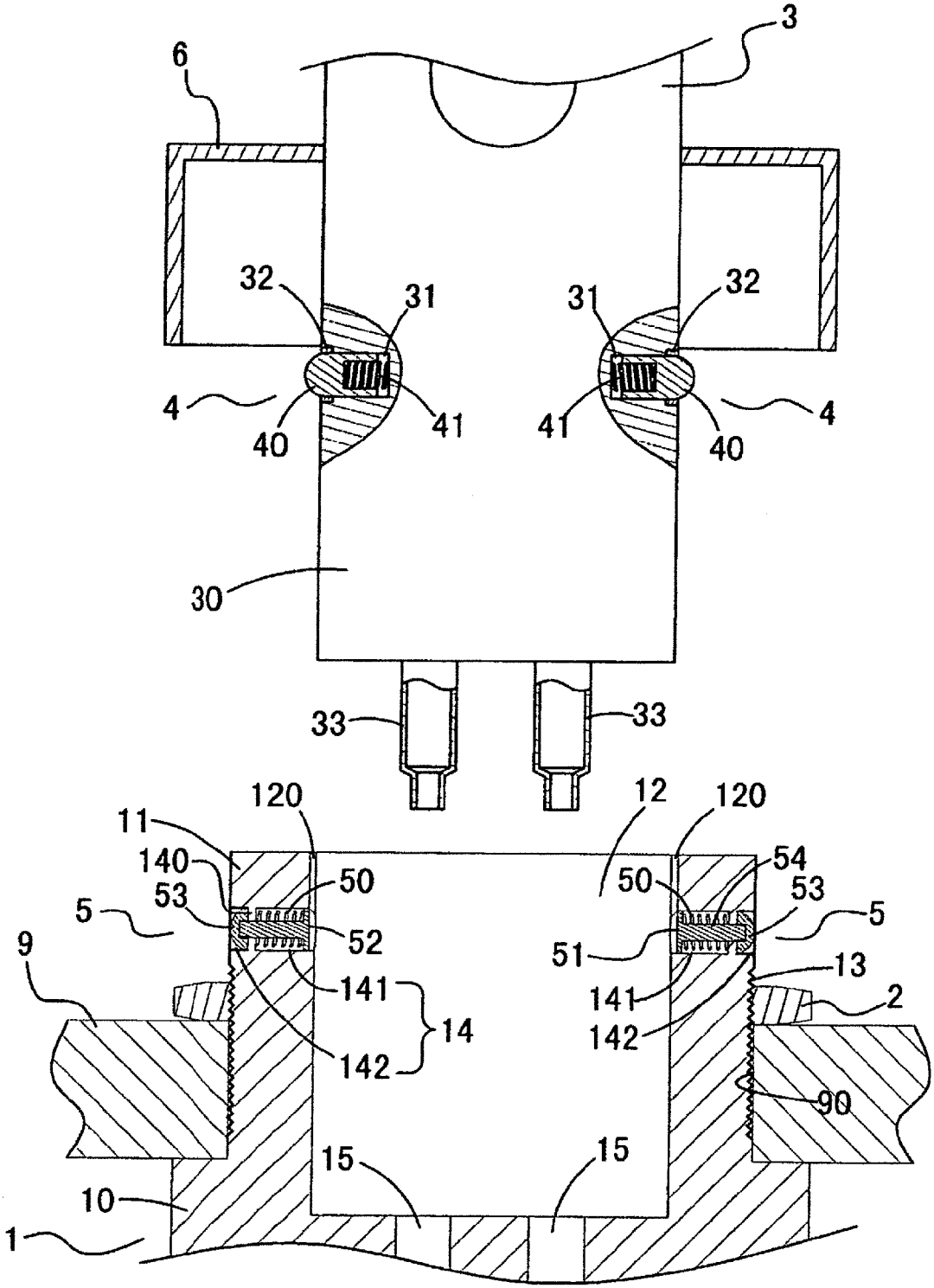
FIGS. 6-8 are cross-sectional views illustrating the operations of the positioning module and releasing module of the present invention in mounting/dismounting a faucet.

Referring to FIGS. 1, 2, and 5, the present invention provides an installation structure of countertop faucet, which comprises a base 1, a locking nut 2, a faucet 3, two positioning modules 4, two releasing modules 5, and a cover 6.

The base 1 comprises a seat 10 that is positionable against and thus abuts the underside of the top of a counter 9 of for example a sink or a wash basin and an insertion section 11 having a reduced diameter and extending through a mounting hole 90 of the counter 9 to project beyond the top surface of the counter 9. The insertion section 11 has a top end in which a receiving bore 12 is formed and delimited by a circumferential wall that has an outside surface forming an external thread section 13 and two positioning holes 14 that are formed in and extending through the circumferential wall at a location above the external thread section 13 to be in communication with the receiving bore.

The locking nut 2 is fit to and engages the external thread section 13 of the insertion section 11 from the top side of the counter 9 in order to cooperate with the seat 10 to clamp the counter 9 from opposite sides.

The faucet 3 has a lower portion forming a joint section 30 that is receivable in the receiving bore 12. The joint section 30 is provided, at opposite sides thereof, with receiving apertures 31.

The two positioning modules 4 are respectively received in the two receiving apertures 31. When the joint section 30 is received in the receiving bore 12 and is moved to the bottom of the bore or any predetermined location, the two positioning modules 4 are resiliently actuated to project into and engage with and thus be retained in the two positioning holes 14 to prevent the joint section 30 from separating from the receiving bore 12.

The two releasing modules 5 are respectively arranged in the two positioning holes 14 for driving the two positioning modules 4 in such a way as to release the engagement with the two positioning holes 14 thereby allowing the joint section 30 to separate from the receiving bore 12.

The cover 6 is fit over the joint section 30 in an axially movable manner. When the joint section 30 is received and retained in the receiving bore 12, the cover 6 is moved downward to cover the locking nut 2 and the portion of the insertion section 11 that extends beyond the top surface of the counter 9 to provide overall aesthetics. To dismount and remove the faucet 3, the cover 6 is first moved upward to expose the two releasing modules 5 in order to provide easy access to and operation of the two releasing modules 5 for dismounting the faucet 3.

Referring to FIGS. 3-6, further detains of the present invention will be described as follows:

The receiving bore 12 has inner surface in which two slide grooves 120 are respectively formed at opposite portions thereof. The two slide grooves 120 respectively extend from the two positioning holes 14 all the way up to the top end surface of the insertion section 11. The two slide grooves 120 are of a predetermined depth (such as 1 mm). Each of the positioning modules 4 comprises a positioning bead 40 and a positioning spring 41. The positioning spring 41 biases the positioning bead 40 outward. Each of the two receiving apertures 31 has an opening to which a closure cap 32 is mounted. The two closure caps 32 respectively house and retain the two positioning beads 40 and the positioning springs 41 in the two receiving apertures 31 in such a way that the two positioning beads 40 are only allow to move outward in a limited outward so as to only project beyond the surface of the joint section 30 to a first distance (such as 4 mm), which is sufficient to allow the positioning beads to reach into the positioning holes 14 without undesired separation. Further, each of the positioning beads 40 is also arranged to at least project beyond the surface of the joint section 30 by a second distance (such as 1 mm) when the positioning bead 40 is moved inward the receiving apertures 31 to the innermost limit and such a second distance is sufficient to allow the positioning beads 40 to be respectively received and retained in the slide grooves 120.

Each of the positioning holes 14 has an inner surface on which a circumferential projection 140 is formed. The circumferential projection 140 divides the interior space of the positioning hole 14 into an inner compartment 141 and an outer compartment 142. Each of the releasing modules 5 comprises a compression spring 50 and a push button 51. The compression spring 50 is received in the inner compartment 141. The push button 51 comprises a pushing section 52 and a button section 53. The pushing section 52 is received in the opening of the inner compartment 141 and the pushing section 52 comprises a bar 54 extending through the compression spring 50 and the circumferential projection 140 to project into the outer compartment 142. The bar 54 has an end forming a thread. The button section 53 is received in the outer compartment 142 and comprises an inner-threaded hole for threading engagement with the thread of the end of the bar 54. The compression spring 50 has an end supported on the circumferential projection 140 and an opposite end supported on the pushing section 52 to normally apply a spring force to maintain the pushing section 52 inside the opening of the inner compartment 141 and the button section 53 completely located inside the outer compartment 142 to enable easy extension of the insertion section 11 through the mounting hole 90 of the counter 9.

Figure 7:
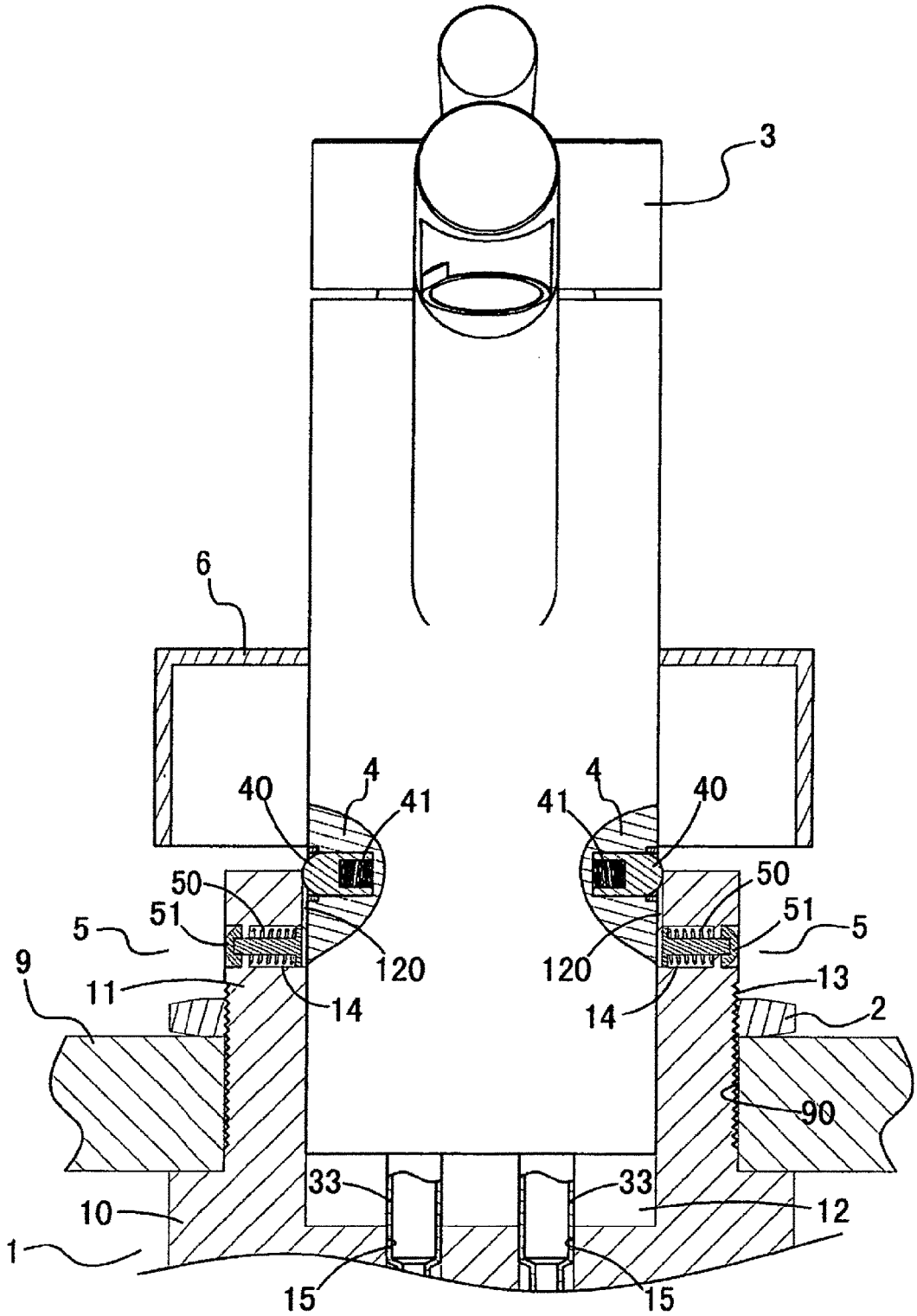

Referring to FIG. 7, when the joint section 30 of the faucet 3 is set to insert into the receiving bore 12 of the base 1, the two positioning beads 40 are set in alignment with the two slide grooves 120 to be received therein so that the two positioning beads 40 are allowed to project beyond the surface of the joint section 30 to the second distance, allowing the two slide grooves 120 to guide the beads to move toward the two positioning holes 14. As such, the faucet 3 is only allowed to be jointed to the base 1 at a predetermined direction and the faucet being mounted in an incorrect direction can be prevented.

Figure 8:
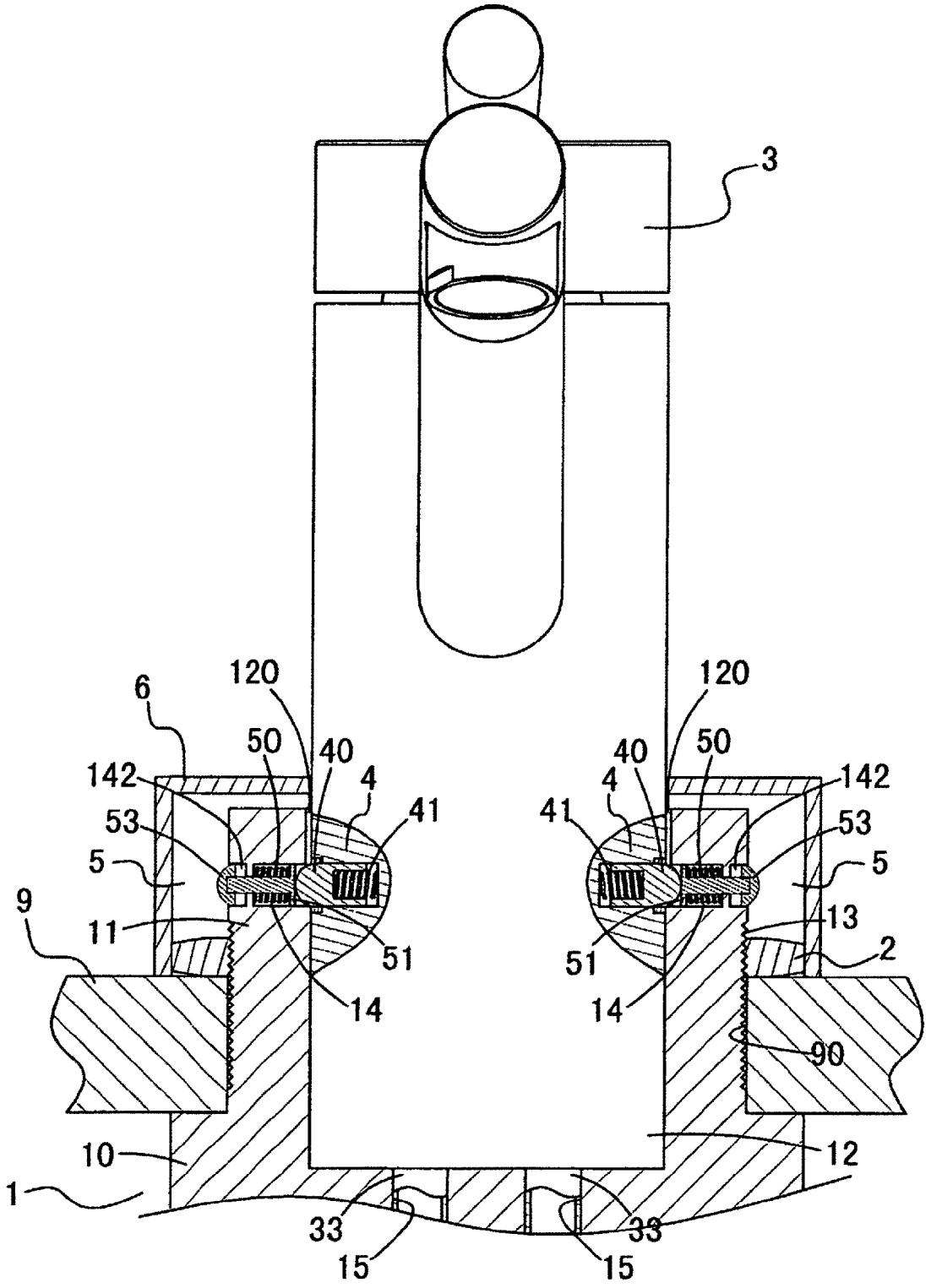

Referring to FIG. 8, when the joint section 30 of the faucet 3 is completely received in the receiving bore 12 of the base 1, the two positioning springs 41 resiliently biased the two positioning bead 40 further outward to reach the first distance beyond the surface of the joint section 30. The two positioning beads 40 are thus fit into the two positioning holes 14 and force the two push buttons 51 to move from inside to outside and compress the two compression spring 50. The button sections 53 are thus made to project beyond the surface of the insertion section 11 and the joint section 30 is kept from separating from the receiving bore 12. Finally, the cover 6 is set downward to cover the locking nut 2 and the portion of the insertion section 11 that projects beyond the top surface of the counter 9. As such, the installation operation of the faucet 3 can be efficiently completed.

On the other hand, to dismount and remove the faucet 3, the cover 6 is moved upward to expose the two releasing modules 5. The button sections 53 of the two push buttons 51 are pushed inwards from the outside to get into the outer compartments 142 of the two positioning holes 14, whereby the two push buttons 51 drive two positioning bead 40 that are located inwardly thereof away from the positioning holes 14 to release the engagement thereof with the positioning holes. As such, the joint section 30 of the faucet 3 can be moved upward to separate from the receiving bore 12 of the base 1, thereby achieving efficient dismounting and removal of the faucet 3.

Figure 9:
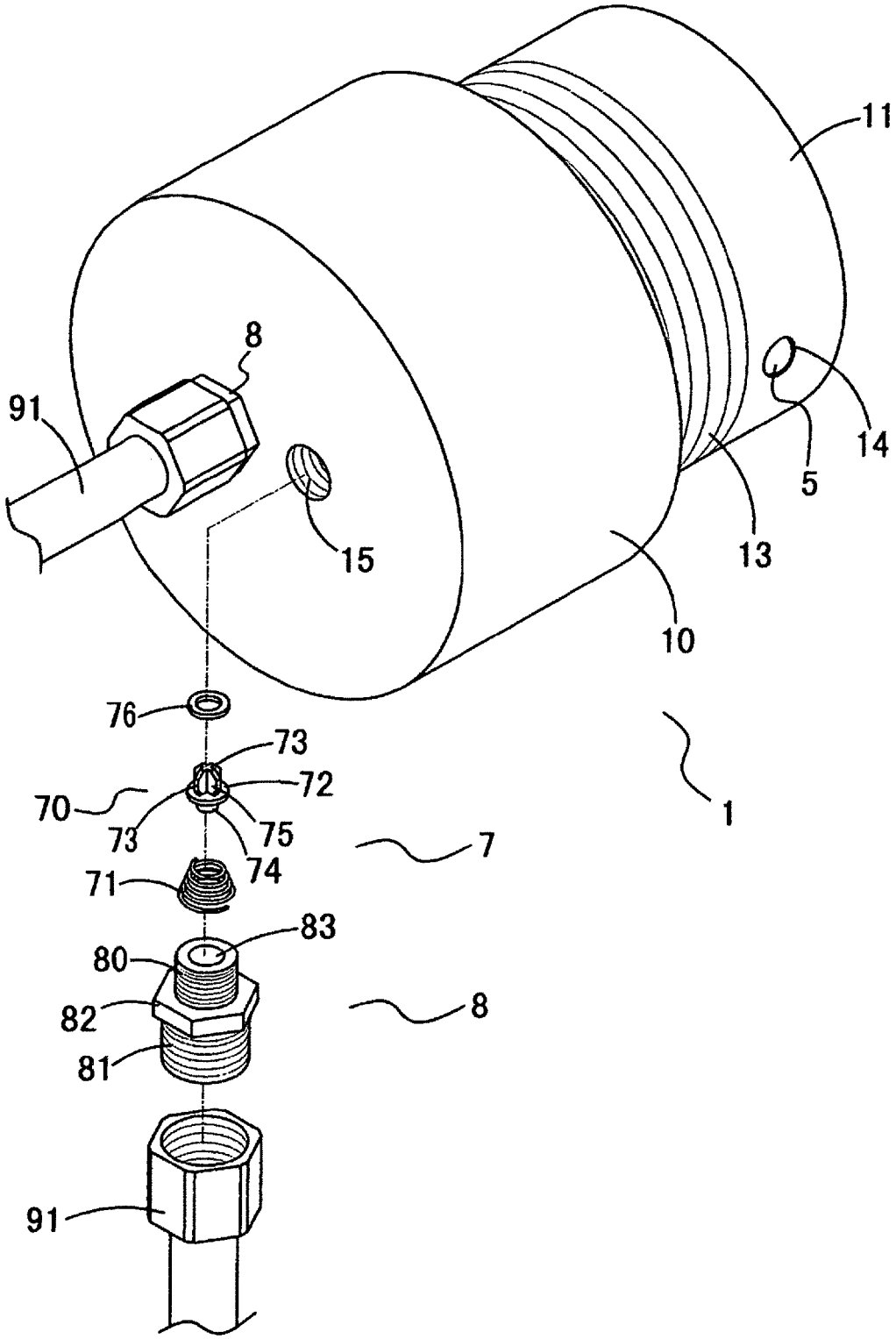
FIG. 9 is an exploded view showing a stop valve according to the present invention.
Figure 10:
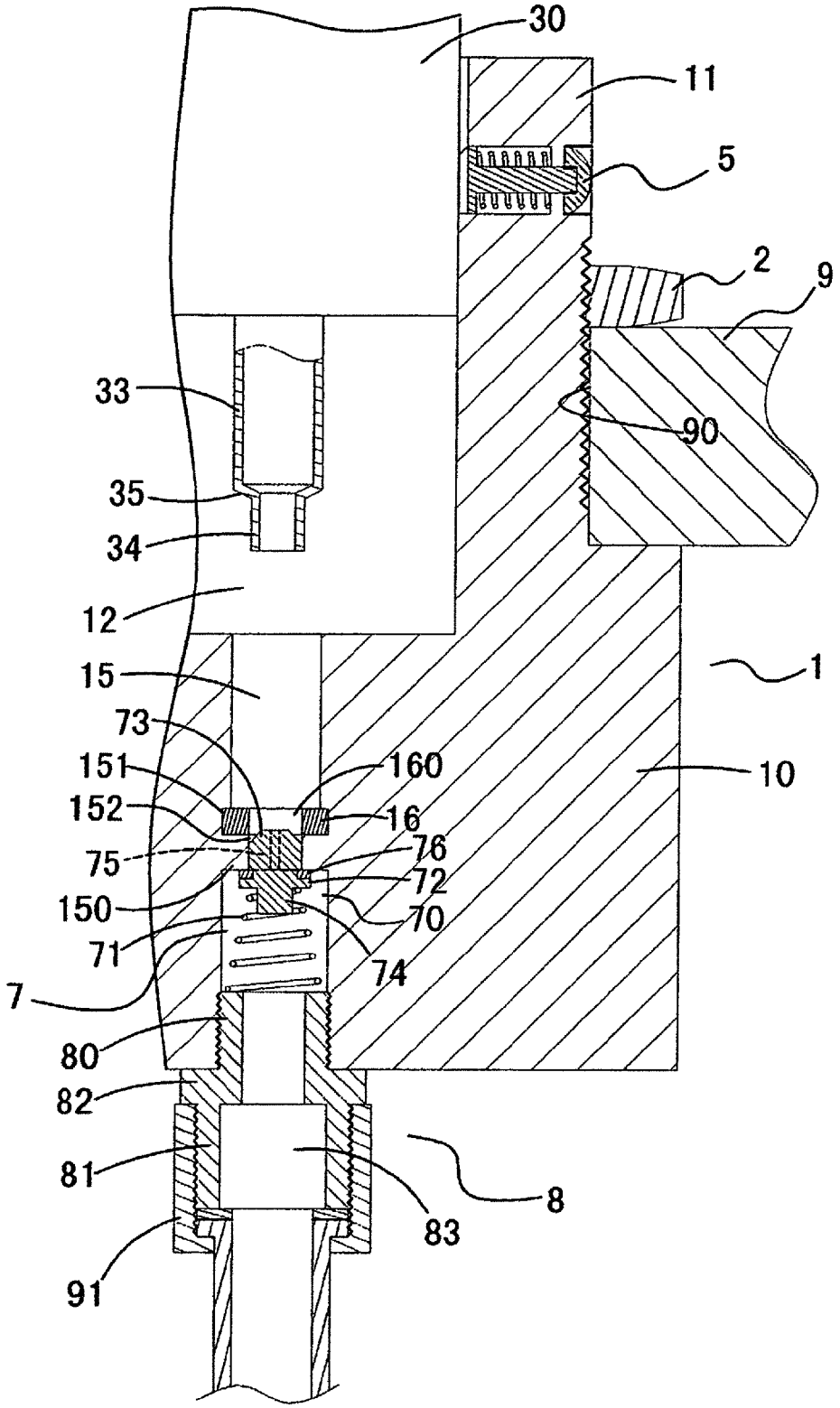
FIGS. 10 and 11 are cross-sectional views illustrating the operation of the stop valve according to the present invention in mounting/dismounting a faucet.

Referring to FIGS. 5, 9, and 10, the installation structure of countertop faucet according to the present invention may further comprise two stop valves 7 and two couplers 8.

The seat 10 of the base 1 has a bottom surface in which two water inlet passages 15 are formed to communicate with the receiving bore 12. Each of the water inlet passages 15 has an inner surface which comprises a circumferential flange 150 formed thereon and a circumferential groove 151 formed therein at a location above the circumferential flange 150. The circumferential flange 150 extends circumferentially and has an inner circumference that defines therein a through hole 152. The circumferential groove 151 receives and retains therein an anti-leakage sealing ring 16. The anti-leakage sealing ring 16 forms a through hole 160. Further, each of the water inlet passages 15 comprises an inner thread formed on the inner surface thereof at a location adjacent to a lower end opening thereof.

The joint section 30 of the faucet 3 has a bottom end surface to which two water guide tubes 33 are provided for respectively inserting into the two water inlet passages 15 to guide water flowing through the two water inlet passages 15 into the faucet 3. Each of the water guide tubes 33 has a lower end that comprises a diameter-reduced abutment section 34 so that the portion located above the abutment section 34 forms a circumferential step 35, which is in the form of a conic surface.

The two stop valves 7 are respectively set in the two water inlet passages 15. Each of the stop valves 7 comprises a valve block 70 and a valve block spring 71. The valve block 70 is movable in the corresponding water inlet passage 15 between a closed position and an open position. The valve block spring 71 is arranged under the valve block 70 to provide a spring force that biases the valve block 70 to move to the closed position. Each of the valve blocks 70 comprises a plug 72, a plurality of ribs 73, and a spring seating block 74. The plurality of ribs 73 are arranged to intersect and form a cruciform configuration on a top of the plug 72 so that a plurality of inter-rib channels 75 is formed between the plurality of ribs 73. The plurality of ribs 73 have outer edges having top portions that are made inclined and lower portions that receive a seal ring 76 fit thereunder. The spring seating block 74 is formed on the bottom of the plug 72 to receive an upper end of the valve block spring 71 to fit thereto. Before the joint section 30 is received in the receiving bore 12, the valve block 70 is biased by the valve block spring 71 to the closed position, where the plurality of ribs 73 extends into the through hole 152 and the seal ring 76 abuts against an under surface of the circumferential flange 150 to block the through hole 152, thereby making the inlet passage 15 blocked.

The two couplers 8 are respectively coupled to the lower end openings of the two water inlet passages 15 and support lower ends of the two valve block springs 71. Each of the couplers 8 comprises a top thread section 80, a bottom thread section 81, and a hexagonal post 82. The top thread section 80 and the bottom thread section 81 are respectively arranged at upper and lower portions of the coupler 8, while the hexagonal post 82 is located between the top and bottom thread sections 80, 81. The top thread section 80 is threadingly engageable with the inner thread of the lower end opening of the corresponding water inlet passage 15. The bottom thread section 81 allows an end of a water inlet tube 91 to threadingly engage therewith. Two water inlet tubes 91 may thus respectively supply hot and cold water. Each of the couplers 8 comprises a through hole 83 extending completely therethrough.

Figure 11:
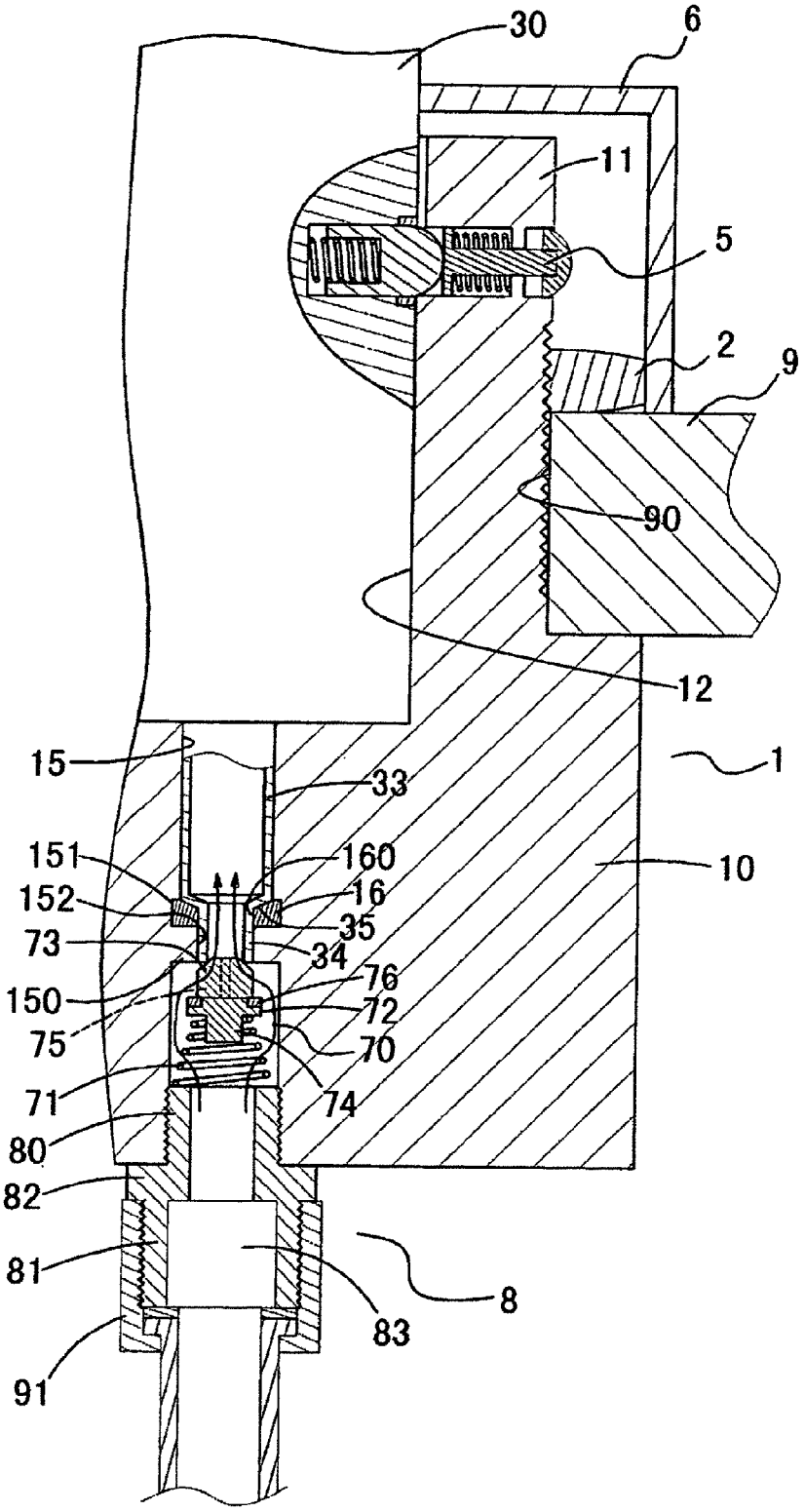

Referring to FIGS. 9 and 11, when the joint section 30 is received in the receiving bore 12, the steps 35 of the water guide tubes 33 are positioned on and depress down upper sides of the anti-leakage sealing rings 16 so as to seal the through holes 160. The abutments section 34 are set through the through holes 160 and the through holes 152 and sit on the inclined edge portions of the ribs 73 of the valve blocks 70 thereby forcing the valve blocks 70 to move from the closed position to the open position to make the water inlet passages 15 respectively in communication with the water guide tubes 33. Under this condition, water flowing through the water inlet passages 15 is allowed to flow up through the plurality of inter-rib channels 75 into the water guide tubes 33.

The base 1 can be mounted in advance under the top of a counter 9 by a plumber. Afterwards, an ordinary person may easily and efficiently mount or dismount the faucet 3 to and from the base 1 by means of the retaining engagement established between the two positioning modules 4 and the two positioning holes 14 and the releasing operations effected between the two releasing modules 5 and the two positioning modules 4, without any concern of water leak. Particularly, the arrangement that the two stop valves 7 allow the two water inlet passages 15 to communicate with the two water guide tubes 33 only when the faucet 3 is mounted to the base 1 and immediately block the two water inlet passages 15 once the faucet 3 is dismounted and removed from the base 1 makes it possible not to shut down the switch valve of water supply in installing the faucet 3. This saves a great amount of installation time and also saves a lot of troubles of installation.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

We claim:

1. An installation structure of countertop faucet, comprising:

a base, which comprises a seat that is adapted to abut an underside of a top of a counter and an insertion section having a reduced diameter and extending through a mounting hole of the counter to partially project beyond the counter, the insertion section having a top end in which a receiving bore is formed and delimited by a circumferential wall that has an outside surface forming an external thread section and two positioning holes that are formed in and extending through the circumferential wall at a location above the external thread section to be in communication with the receiving bore, the seat having a bottom surface in which two water inlet passages are formed to communicate with the receiving bore;

a locking nut, which is fit to and engages the external thread section of the insertion section in order to cooperate with the seat to clamp the counter;

a faucet, which comprises a joint section that is receivable in the receiving bore, the joint section having a bottom end surface to which two water guide tubes are provided for respectively inserting into the two water inlet passages, the joint section being provided, at opposite sides thereof, with receiving apertures;

two positioning modules, which are respectively received in the two receiving apertures, each of the positioning modules comprising a positioning bead and a positioning spring, the positioning spring biasing the positioning bead outward to get into a corresponding one of the positioning holes;

two releasing modules, which are respectively arranged in the two positioning holes, each of the releasing modules comprising a push button adapted to be pushed inwardly from outside to drive the positioning bead out of the positioning hole;

a cover, which is fit over the joint section in an axially movable manner to cover the locking nut and a portion of the insertion section that projects beyond the counter;

two stop valves, which are respectively set in and thus selectively block the two water inlet passages, whereby when the joint section is received in the receiving bore, the two water guide tubes drive the two stop valves to open the communication between the two water inlet passages and the two water guide tube; and two couplers, which are respectively coupled to lower end openings of the two water inlet passages and adapted to connect water inlet tubes so as to guide an external supply of water into the water inlet passages.

2. The installation structure of countertop faucet according to claim 1, wherein each of the water inlet passages of the base has an inner surface which comprises a circumferential flange formed thereon and a circumferential groove formed therein at a location above the circumferential flange, the circumferential flange having an inner circumference defining therein a through hole, the circumferential groove receiving and retaining therein an anti-leakage sealing ring, the anti-leakage sealing ring forming a through hole, each of the stop valves comprising a valve block and a valve block spring, the valve block being movable in the water inlet passages between a closed position where the through hole of the flange is closed and an open position where the through hole is opened, the valve block spring having a lower end supported on the corresponding coupler and an upper end supported on bottom of the valve block to provide a spring force for biasing the valve block to move to the closed position, each of the water guide tubes of the faucet having a lower end that comprises a diameter-reduced abutment section so that a step is defined above the abutment section, whereby when the joint section of the faucet is received in the receiving bore, the step is positioned on and depresses down an upper side of the anti-leakage sealing ring to seal the through hole of the ring, the abutment section being set through the through hole of the anti-leakage sealing ring and the through hole of the circumferential flange to force the valve block to move from the closed position to the open position.

3. The installation structure of countertop faucet according to claim 2, wherein each of the valve blocks comprises a plug, a plurality of ribs, and a spring seating block, the ribs being arranged on a top of the plug, the ribs defining therebetween a plurality of inter-rib channels, the ribs having outer edges having top portions that are made inclined and lower portions that receive a seal ring fit thereunder, the spring seating block being formed on the bottom of the plug to receive an upper end of the valve block spring to fit thereto, whereby when the valve block is at the closed position, the ribs extend into the through hole of the circumferential flange and the seal ring abuts against an under surface of the circumferential flange to block the through hole, and when the valve block is at the open position, the lower ends of the abutment sections of the water guide tubes sit on the inclined edge portions of the ribs to allow water flowing through the water inlet passages to flow through the inter-rib channels into the water guide tubes.

4. The installation structure of countertop faucet according to claim 3, wherein the steps of the water guide tubes are in the form of a conic surface.

5. The installation structure of countertop faucet according to claim 3, wherein each of the positioning holes of the base has an inner surface on which a circumferential projection is formed, the circumferential projection dividing an interior space of the positioning hole into an inner compartment and an outer compartment, each of the releasing modules comprising a compression spring received the inner compartment, the push button comprising a pushing section and a button section, the pushing section being received in an opening of the inner compartment, the pushing section comprising a bar extending through the compression spring and the circumferential projection to project into the outer compartment, the button section being received in the outer compartment and mounted to an end of the bar, the compression spring having an end supported on the circumferential projection and an opposite end supported on the pushing section to normally apply a spring force to maintain the pushing section inside the opening of the inner compartment and the button section completely located inside the outer compartment, whereby when the corresponding positioning bead is fit into the positioning hole, the pushing section is pushed to compress the compression spring and make the button section projecting beyond a surface of the insertion section.

6. The installation structure of countertop faucet according to claim 5, wherein the end of the bar forms a thread and the button section comprises an inner-threaded hole for threading engagement with the thread of the end of the bar.

7. The installation structure of countertop faucet according to claim 5, wherein the receiving bore has inner surface in which two slide grooves are respectively formed at opposite portions thereof, the two slide grooves respectively extending from the two positioning holes to the top end surface of the insertion section, whereby when each of the positioning beads is moved inwardly into the corresponding receiving aperture to an innermost limit, the positioning bead projects beyond the surface of the joint section by a predetermined distance that is sufficient to allow the positioning bead to be received and retained in the corresponding slide groove.

8. The installation structure of countertop faucet according to claim 7, wherein the two receiving apertures having openings each of which receives a closure cap mounted thereto, whereby the two closure caps respectively house and retain the two positioning beads and the positioning springs in the two receiving apertures.

9. The installation structure of countertop faucet according to claim 7, wherein each of the water inlet passages of the base has a lower end opening in which an inner thread is formed, each of the couplers comprising a top thread section, a bottom thread section, and a hexagonal post, the top thread section and the bottom thread section being respectively arranged at upper and lower portions of the coupler, the hexagonal post being located between the top and bottom thread sections, the top thread section being threadingly engageable with the inner thread of the lower end opening of the corresponding water inlet passage, the bottom thread section being adapted to threadingly couple an end of a water inlet tube, each of the couplers comprising a through hole extending completely therethrough.

* * * * *